US011470977B2

(12) United States Patent
Emmons et al.

(10) Patent No.: US 11,470,977 B2
(45) Date of Patent: Oct. 18, 2022

(54) MATTRESS SUPPORT

(71) Applicant: Hill-Rom Services, Inc., Batesville, IN (US)

(72) Inventors: Kirsten Emmons, Batesville, IN (US); David Ribble, Indianapolis, IN (US); Craig M. Meyerson, Syracuse, NY (US); Ibne Soreefan, West Chester, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 116 days.

(21) Appl. No.: 16/890,418

(22) Filed: Jun. 2, 2020

(65) Prior Publication Data

US 2020/0383491 A1 Dec. 10, 2020

Related U.S. Application Data

(60) Provisional application No. 62/857,107, filed on Jun. 4, 2019.

(51) Int. Cl.

| | |
|---|---|
| ***A47C 20/04*** | (2006.01) |
| ***A61G 7/00*** | (2006.01) |
| ***A61G 7/018*** | (2006.01) |
| ***A61G 7/057*** | (2006.01) |

(52) U.S. Cl.

CPC ..... *A47C 20/048* (2013.01); *A61G 7/00* (2013.01); *A61G 7/018* (2013.01); *A61G 7/05769* (2013.01); *A61G 7/05776* (2013.01)

(58) Field of Classification Search

CPC ..... A61G 7/00; A61G 7/018; A61G 7/05769; A61G 7/05776; A61G 13/1265; A61G 2203/30; A61G 2203/10; A61G 2203/42; A47C 20/04; A47C 20/048

See application file for complete search history.

(56) References Cited

U.S. PATENT DOCUMENTS

| | | | | |
|---|---|---|---|---|
| 5,311,625 | A * | 5/1994 | Barker | A47C 31/008 417/363 |
| 5,794,289 | A * | 8/1998 | Wortman | A61G 7/05769 5/713 |
| 6,012,186 | A * | 1/2000 | Soltani | A47C 31/008 5/613 |
| 10,660,807 | B2 | 5/2020 | Ribble et al. | |

(Continued)

FOREIGN PATENT DOCUMENTS

EP 3466391 A1 4/2019

OTHER PUBLICATIONS

"Clip." Oxford, Oxford Learner's Dictionaries, www.oxfordlearnersdictionaries.com/us/definition/english/clip_1?q=clip.*

(Continued)

*Primary Examiner* — David R Hare
*Assistant Examiner* — Madison Emanski
(74) *Attorney, Agent, or Firm* — Price Heneveld LLP

(57) ABSTRACT

A mattress support assembly includes a mattress cover that has a coupling feature. A support casing defines an attachment feature and is selectively coupled to the mattress cover via the coupling feature. A support member is operably coupled to the attachment feature of the support casing. The support member has a load surface, a base surface, and an expandable body defined between the load surface and the base surface.

16 Claims, 7 Drawing Sheets

(56) References Cited

U.S. PATENT DOCUMENTS

| | | | | |
|---|---|---|---|---|
| 2005/0114998 | A1 | 6/2005 | Leventhal et al. | |
| 2010/0101022 | A1* | 4/2010 | Riley | A61B 5/024 702/19 |
| 2020/0100597 | A1 | 4/2020 | Ribble et al. | |
| 2020/0100968 | A1 | 4/2020 | Ribble et al. | |
| 2020/0100969 | A1 | 4/2020 | Ribble et al. | |

OTHER PUBLICATIONS

"Mattress Ticking Material." McMichael Mills, 2019, https://www.mcmichaelmills.com/products/mattress-ticking-yarns.aspx.*

* cited by examiner

MATTRESS SUPPORT

CROSS-REFERENCE TO RELATED APPLICATION

This application claims the benefit under 35 U.S.C. § 119(e) to U.S. Provisional Patent Application No. 62/857,107, filed Jun. 4, 2019, entitled "MATTRESS SUPPORT," which is incorporated herein by reference in its entirety.

FIELD OF THE DISCLOSURE

The present disclosure generally relates to a mattress support, and more specifically, to a mattress support to be used with a mattress to provide additional mattress functionality to a user.

SUMMARY OF THE DISCLOSURE

A mattress assembly includes a mattress including a mattress cover and a coupling feature coupled to the mattress cover. A support casing is disposed beneath the mattress and is operably coupled to the mattress cover via the coupling feature. The support casing defines at least one attachment feature. At least one support member is disposed on and is selectively coupled with the at least one attachment feature of the support casing. The at least one support member is operable between a deployed condition and a non-deployed condition.

A mattress support includes a mattress cover and a support casing defining an attachment feature. A support member is selectively coupled with the attachment feature of the support casing. The support member is operable between a deployed condition and a non-deployed condition. A coupling feature couples the mattress cover to the support casing.

A mattress support assembly includes a mattress cover that has a coupling feature. A support casing defines an attachment feature and is selectively coupled to the mattress cover via the coupling feature. A support member is operably coupled to the attachment feature of the support casing. The support member has a load surface, a base surface, and an expandable body defined between the load surface and the base surface.

These and other features, advantages, and objects of the present disclosure will be further understood and appreciated by those skilled in the art by reference to the following specification, claims, and appended drawings.

DETAILED DESCRIPTION

Figure 1:
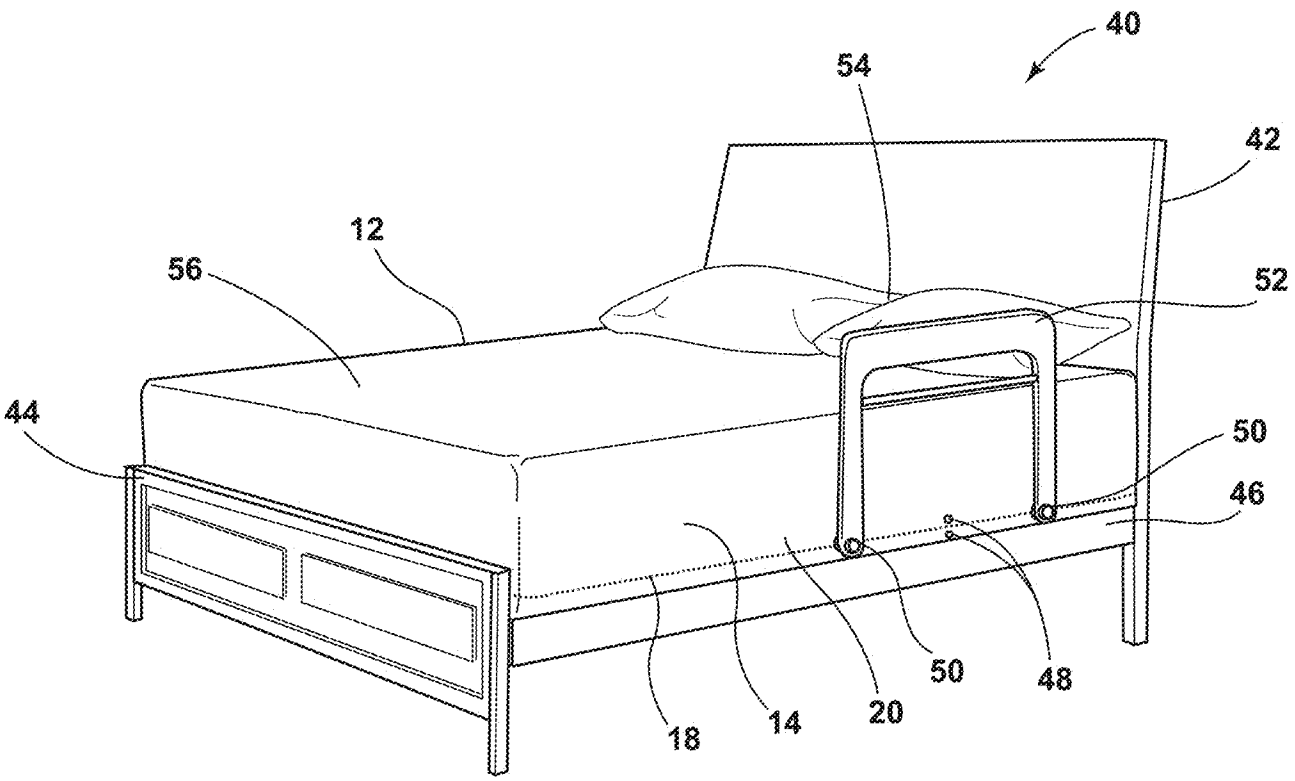
FIG. 1 is a side perspective view of a bed of the present disclosure.

The present illustrated embodiments reside primarily in combinations of apparatus components related to patient support device. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to a surface of the device closest to an intended viewer, and the term "rear" shall refer to a surface of the device furthest from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-11, reference numeral 10 generally designates a mattress assembly including a mattress 12 that has a mattress cover 14 and a coupling feature 16 coupled to the mattress cover 14. A support casing 18 is disposed beneath the mattress 12 and is operably coupled to the mattress cover 14. The support casing 18 defines at least one attachment feature 20, and at least one support member 22 is positioned proximate to and is operably coupled with the attachment feature 20 of the support casing 18. The at least one support member 22 is operable between a deployed condition 24 and a non-deployed condition 26.

The use of medical-grade equipment in residential homes is becoming increasingly common. However, many consumer beds do not include proper attachment components for incorporating medical equipment with traditional beds. As an example, certain ailments may justify an angled mattress support that provides increased comfort or improved health to a user during rest. For example, a user with sleep apnea may find improved health or comfort during rest if a mattress 12 is angled or canted relative to the bed frame. The mattress cover 14, the support casing 18, and the at least one support member 22 can be collectively described as a mattress support 28, which, whether incorporated into an existing mattress or whether supplied with a purchased mattress, allows the user to actuate one or more support members 22 thereby adjusting a relative angle of mattress 12. It is generally contemplated that each component of the mattress support 28 may be preassembled with the mattress support 28, or the mattress support 28 may be assembled at a later time.

Figure 2:
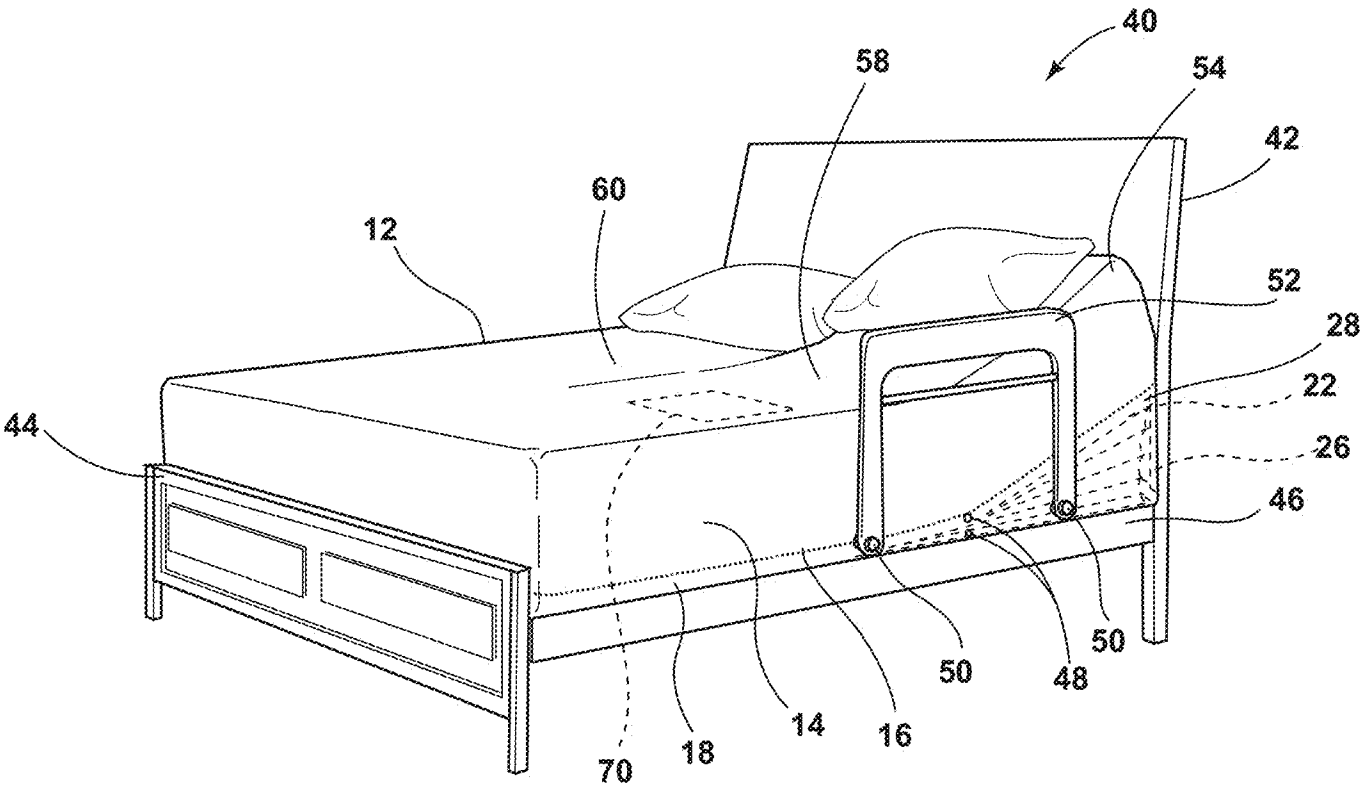
FIG. 2 is a side perspective view of a bed and a mattress support of the present disclosure.

With reference now to FIGS. 1 and 2, in addition to the mattress 12, the illustrated bed 40 includes a headboard 42, a footboard 44, and a frame 46. The support casing 18 of the mattress support 28 is positioned underneath the mattress 12, such that the support casing 18 is between the mattress 12 and the frame 46. The support casing 18 may include apertures 48 through which wiring, tubing, and/or cords may pass. In addition, connecting features 50 may be positioned on a side of the support casing 18 for securing a safety rail 52 to the bed 40. A head portion 54 of the mattress 12 is proximate the headboard 42, and a foot portion 56 of the mattress 12 is proximate the footboard 44. In order to accommodate the user, the mattress 12 may include a first head portion 58 and a second head portion 60 that are selectively and independently movable relative to one another. For example, the first head portion 58 is illustrated in FIG. 2 as raised by the support member 22 relative to the second head portion 60.

As mentioned, the first head portion 58 of the mattress 12 may be raised while the second head portion 60 of the mattress 12 remains stationary. Thus, the user may independently adjust the first head portion 58 of the mattress 12 without disturbing the second head portion 60. Similarly, the foot portion 56 may include separate portions, which may be independently movable as described with respect to the first and second head portions 58, 60. Therefore, a greater range of lateral rotation of the mattress 12 may be available in conjunction with the support member 22.

The mattress cover 14 and the support casing 18 may be comprised of a generally flexible or elastomeric material that may accommodate such gradual lateral and longitudinal articulations of the mattress 12. When incorporating the mattress support 28 into the bed 40, the mattress cover 14 wraps around the mattress 12, such that the mattress cover 14 partially encases the mattress 12. The mattress 12 may be a medical mattress that fully integrates the mattress support 28 or an existing mattress to which the mattress support 28 may be assembled. Both configurations, however, include all of the features of the mattress support 28 described herein. For example, the user may purchase a mattress 12 in which the mattress support 28 is already integrated into the mattress 12, such that the mattress cover 14 and the coupling features 16 are part of the mattress 12.

Figure 4:
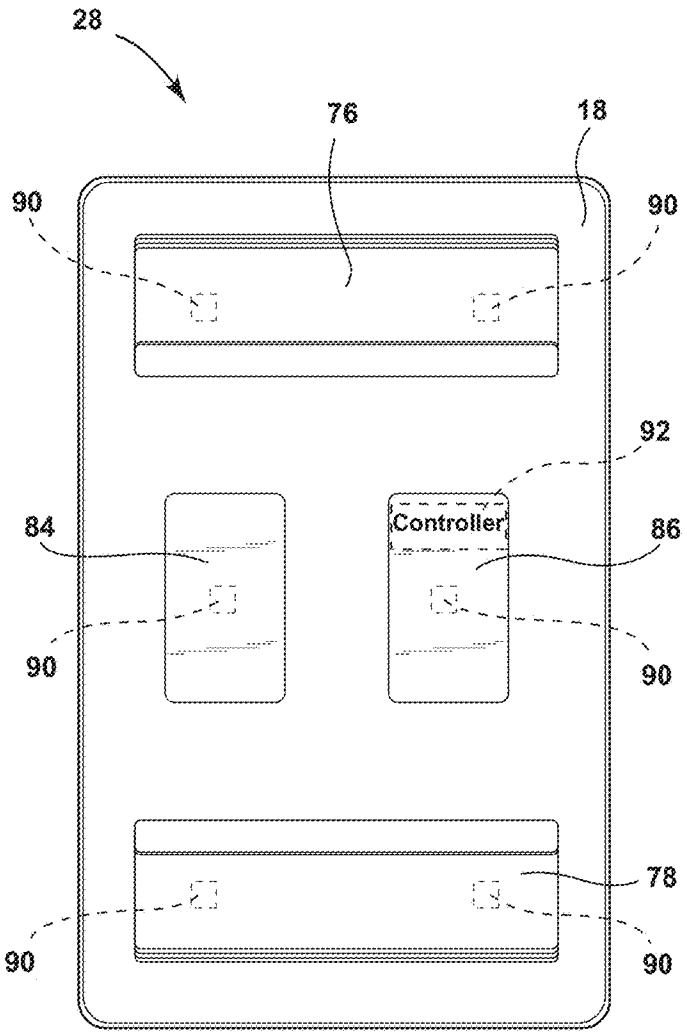
FIG. 4 is a top plan view of a support casing of a mattress support of the present disclosure.
Figure 3:
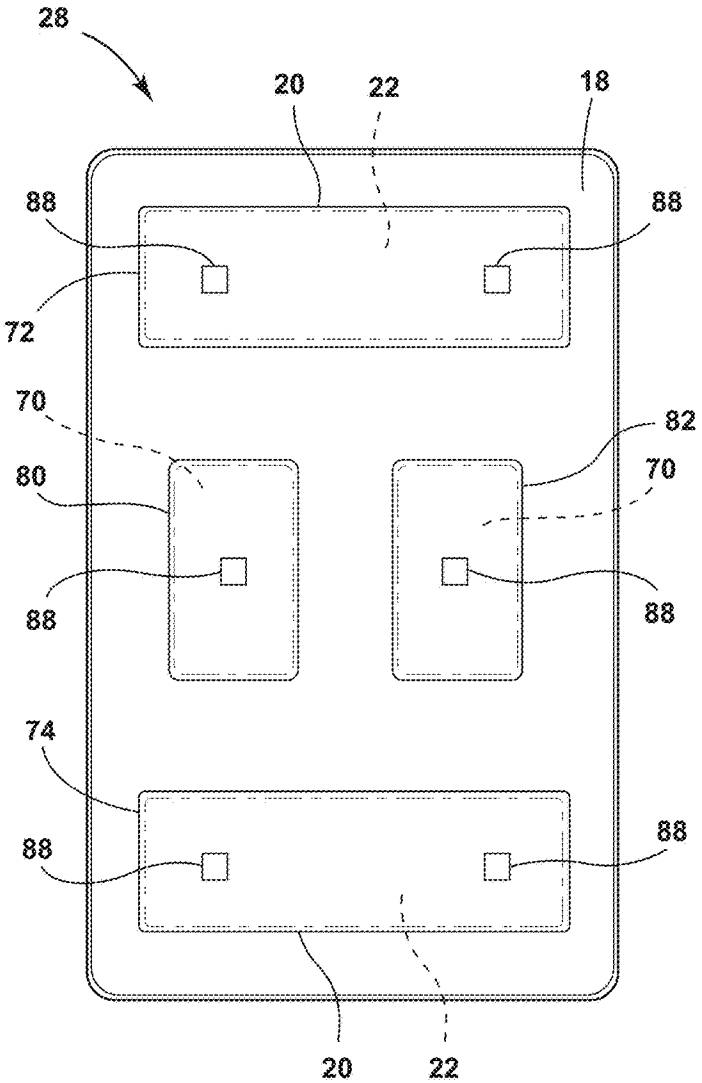
FIG. 3 is a top plan view of a support casing of a mattress support of the present disclosure.

With reference now to FIGS. 2-4, the attachment features 20 of the mattress support 28 are configured to receive the support member 22 and/or at least one sensor pad 70. It is generally contemplated that the support member 22 extends along a width of the support casing 18. As depicted in FIG. 3, the support casing 18 includes first and second attachment features 72, 74 configured to receive first and second support members 76, 78, respectively. It is generally contemplated that the first support member 76 may be positioned at the first head portion 58 and the second support member 78 may be positioned at the second head portion 60. Additionally or alternatively, the first support member 76 may be positioned at the head portion 54 and the second support member 78 may be positioned at the foot portion 56 on the same side of the mattress 12.

By way of example, not limitation, the first and second attachment features 72, 74 may include a first clip 72 and a second clip 74. In addition, the first and second support members 76, 78 may be a first air bladder 76 and a second air bladder 78 positioned on the same side of the support casing 18. However, the first and second support members 76, 78 may include other constructions, described further below. When positioned under the mattress 12, the first and second support members 76, 78 are positioned generally at the head and foot portions 54, 56 of the mattress 12, respectively. The support casing 18 can also include third and fourth attachment features 80, 82 to which first and second sensor pads 84, 86 are coupled, respectively. For example, the sensor pad 70 may be coupled to a third attachment feature 80, or third clip 80, to secure the sensor pad 70 to the support casing 18. Alternatively, the sensor pad 70 may be positioned separately from the support casing 18. In such alternative construction, the sensor pad 70 is positioned relative the mattress cover 14 of the mattress support 28 so that it may detect, for example, wetness.

Additionally, the attachment features 20 include fasteners 88 that couple to corresponding retention features 90 of each of the support members 22 and the sensor pad 70. The fasteners 88 and the retention features 90 may be any one of a snap, clasp, adhesive, or other securing members generally known in the art. Accordingly, the user or the caregiver can remove and replace the support member 22 and the sensor pad 70 with minimal difficulty. The fasteners 88 and the retention features 90 minimize potential shifting of the support member 22 when the user articulates the support member 22 and, ultimately, the mattress 12. For example, the support member 22 may be adjustable between the non-deployed, or generally flat, condition 26 and the deployed, or raised, condition 24, which consequently repositions the mattress 12. For example, the user can raise the head portion 54 of the mattress 12 by deploying the first support member 76. Similarly, the user can raise the foot portion 56 of the mattress 12 by deploying the second support member 78. The first and second support members 76, 78 expand gradually, which allows the user to selectively control the height at which the mattress 12 is adjusted.

Referring still to FIGS. 2-4, the retention features 90 retain the respective support member 22 and the sensor pad 70 by coupling to the fasteners 88 of the attachment features 20 during articulation of the mattress 12. Minimized shifting or movement allows the sensor pad 70 to provide more consistent data to the user or the caregiver. For example, coupling the first and second sensor pads 84, 86 to the third and fourth attachment features 80, 82 helps to secure the first and second sensor pads 84, 86 relative to the support casing 18. By way of example, not limitation, the sensor pad 70 may be a bed exit sensor, a contactless respiratory rate monitor, a heart rate monitor, and/or a sleep monitor such that the sensor pad 70 may track vitals and movement of the user without directly contacting the user. Accordingly, the more securely the sensor pad 70 is coupled with the support casing 18 of the mattress support 28, the more reliable data outputs of the sensor pad 70 may be. The sensor pad 70 is communicatively coupled to a controller 92, which is configured to receive the data outputs from the sensor pad 70 to transmit the data outputs to the user. The controller 92 may be integrally formed with the sensor pad 70 or may be coupled to the sensor pad 70, for example via wires.

As mentioned above, it is also contemplated that the sensor pad 70 can be alternatively positioned between the mattress cover 14 and the mattress 12, rather than the support casing 18. In such configuration, the sensor pad 70 may include a passive radio-frequency identification (RFID) antenna configured to detect incontinence and to alert a caregiver or the user when the sensor pad 70 and/or other linens should be changed. The sensor pad 70 can then be coupled to the mattress cover 14 to securely retain the sensor pad 70 in a user-selected position relative to the mattress 12.

Figure 5:
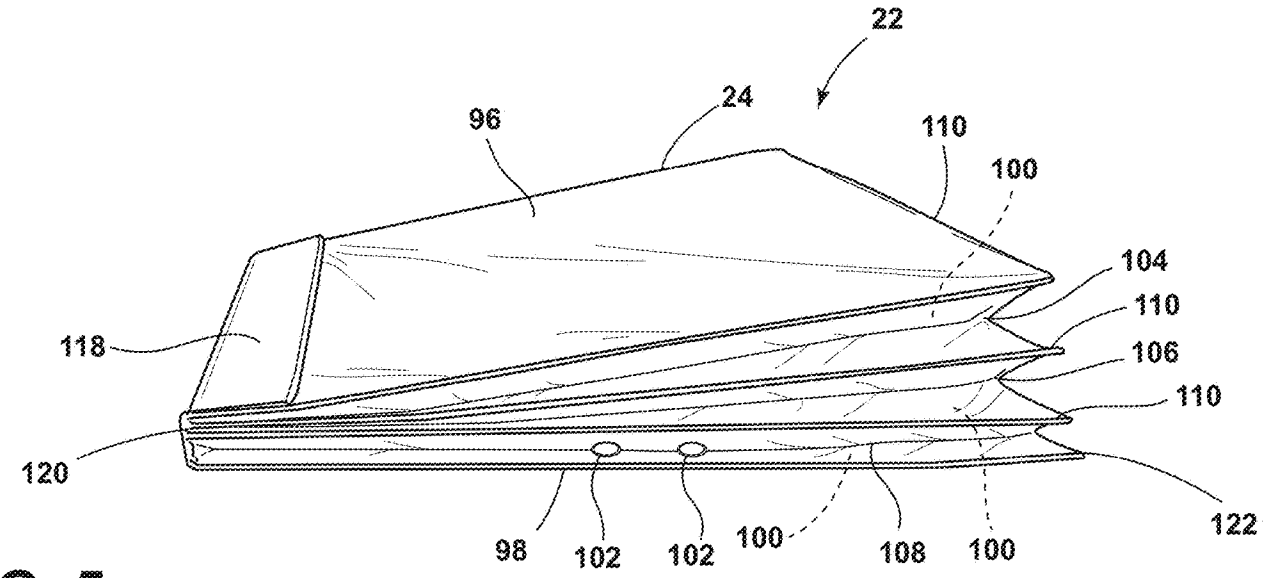
FIG. 5 is a side perspective view of a support member in a deployed condition of the present disclosure.
Figure 6:
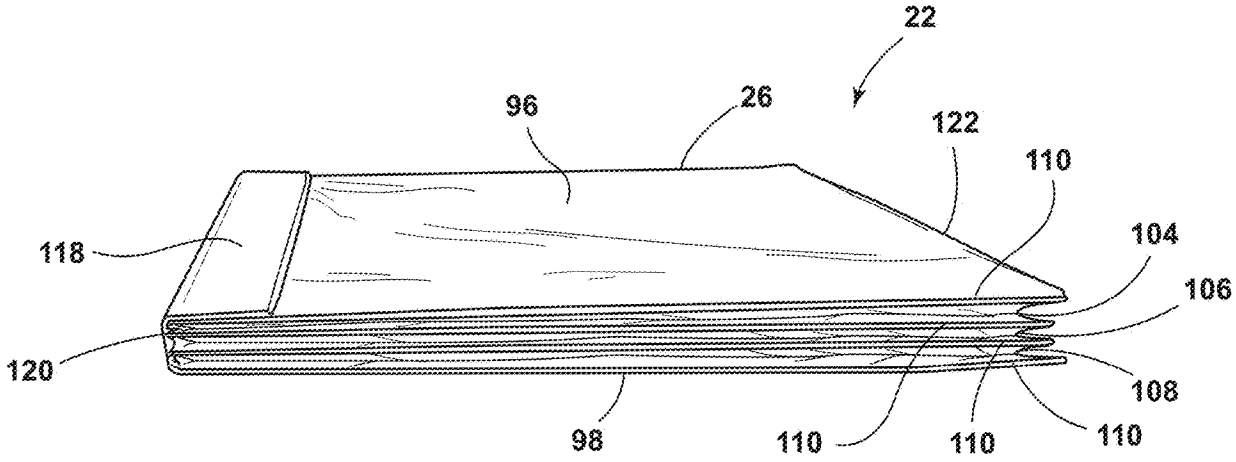
FIG. 6 is a side perspective view of the support member of FIG. 5 in a non-deployed condition of the present disclosure.

With reference now to FIGS. 5 and 6, the support member 22 of the mattress support 28 (FIG. 4) includes a load surface 96 and a base surface 98, as well as at least one expandable body 100 positioned between the load surface 96 and the base surface 98. The expandable body 100 generally defines ports 102, which are configured to correspond with the apertures 48 defined by the support casing 18. As described below, it is generally contemplated that tubing may pass through the apertures 48 to couple to the ports 102 to generally regulate the deployment of the expandable body 100.

The expandable body 100 may take the form of an accordion or bellows configuration, such that folds are formed. As illustrated, the expandable body 100 is defined by a first fold 104, a second fold 106, and a third fold 108, each of which is defined further by rims 110. It is generally contemplated that the support member 22 may include a plurality of expandable bodies 100 each being defined by a fold. In the construction having the plurality of expandable bodies 100, it is contemplated that each expandable body 100 can fill with fluid independently and selectively to adjust the support member 22. Although shown as having three folds, it is also contemplated that the expandable body 100 may have no folds, less than three folds, or greater than three folds.

As illustrated in FIGS. 5 and 6, the first, second, and third folds 104, 106, 108 of the expandable body 100 are generally held together by a binding member 118. The binding member 118 may have a minimal thickness, such that the support member 22, when fully compressed, fits within the support casing 18. Thus, the binding member 118 has a thickness corresponding with the fully compressed condition of the support member 22. In addition, the binding member 118 secures a static end 120 of the support member 22 to inhibit movement of the static end 120 during deployment, for example inflation, of the support member 22. This inhibition of the static end 120 assists in raising specific portions of the mattress 12 by creating a generally angled position of the mattress support 28. A dynamic end 122 opposes the static end 120 of the support member 22. The dynamic end 122 has the same relative thickness as the binding member 118 when in the non-deployed condition 26.

Referring still to FIGS. 5 and 6, the dynamic end 122 expands and contracts as fluid is introduced to the expandable body 100. Consequently, during expansion, each fold may expand at a different or varying rate. For example, as depicted in FIG. 5, the first fold 104 is slightly more expanded than the third fold 108. Accordingly, as the support member 22 is deployed, the expandable body 100 of the first fold 104 typically expands before the expandable body 100 of a fold most proximate the base surface 98. Additionally or alternatively, the first fold 104 is typically expanded before a fold most proximate to the base surface 98 when the expandable body 100 transitions from the non-deployed condition 26 to the deployed condition 24, such that a single expandable body 100 is disposed within the support member 22. In the non-deployed, or deflated, condition 26, the support member 22 compresses further in response to the weight of the mattress 12 (FIG. 2), such that the support member 22 lays generally flat between the mattress 12 (FIG. 2) and the support casing 18. Stated differently, the fluid is selectively released from the support member 22 in the non-deployed condition 26, such that the support member 22 is flat and pliable to compression. However, when the support member 22 is in the deployed, or expanded, condition 24, the support member 22 is typically rigid and generally resists the compressive force of the mattress 12 (FIG. 2).

Moreover, the load and base surfaces 96, 98 maintain generally planar configurations when the support member 22 moves between the deployed and non-deployed conditions 24, 26. As the support member 22 may have various configurations, the rigidity of the load and base surfaces 96, 98 provides a generally flat contact area with the mattress 12 and frame 46, respectively. It is generally contemplated that the base surface 98 may be coupled to the attachment feature 20 (FIG. 4) of the support casing 18 (FIG. 4). The expandable body 100 of the support member 22 may be a bellows, a bladder, a wedge, a balloon, a pneumatic or hydraulic lift, or any other deployable support device known in the art. By way of example, not limitation, where a balloon construction is used for the support member 22, as the balloon fills with fluid, the balloon will have a tendency to form a round body. Thus, the generally rigid load surface 96 provides a generally flat surface on which the mattress 12 may rest, while the base surface 98 provides a generally flat surface for the support member 22 and support casing 18 to be in contact with the frame 46 (FIG. 2) of the bed 40 (FIG. 2).

Referring to FIGS. 2, 5, and 6, it is generally contemplated that the support member 22 may provide gradual and lateral rotation of the mattress 12, such that the support member 22 may raise the head portion 54 approximately 45-degrees. However, the support member 22 may raise the head portion 54 to a range of angles less than 45-degrees and greater than 45-degrees. Additionally or alternatively, the support member 22 may, for example, raise the foot portion 56 approximately 8-inches. It is also contemplated that the support member 22 may raise the foot portion 56 less than 8-inches or greater than 8-inches. The support member 22 may also provide lateral rotation of the mattress 12, such that the mattress 12 can be both raised and laterally rotated by the support member 22.

Figure 7:
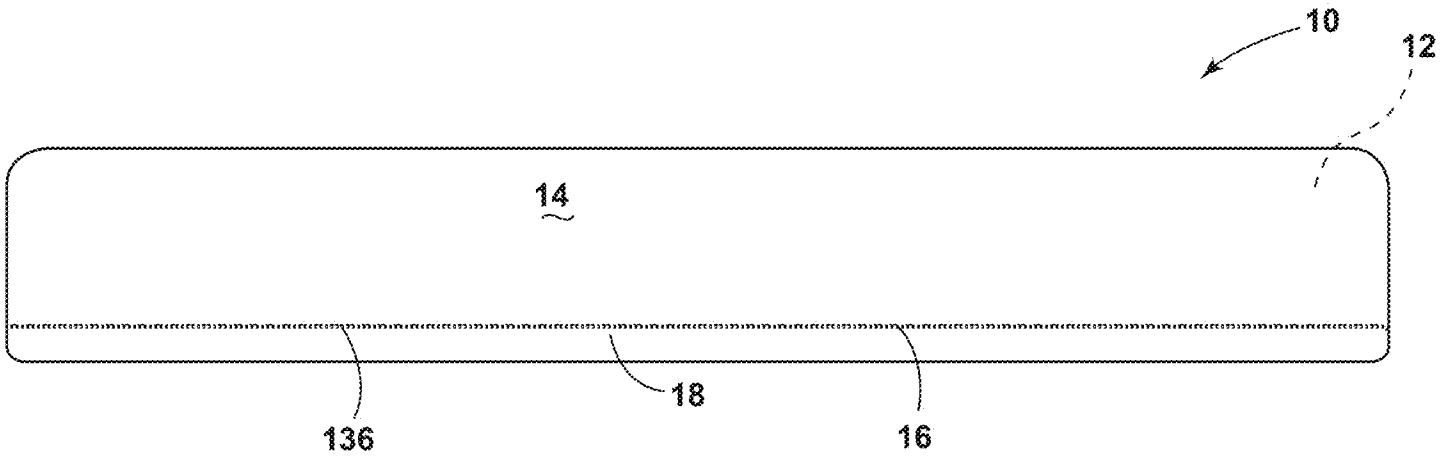
FIG. 7 is a side elevational view of an upper mattress cover and a support casing of a mattress support of the present disclosure.
Figure 8:
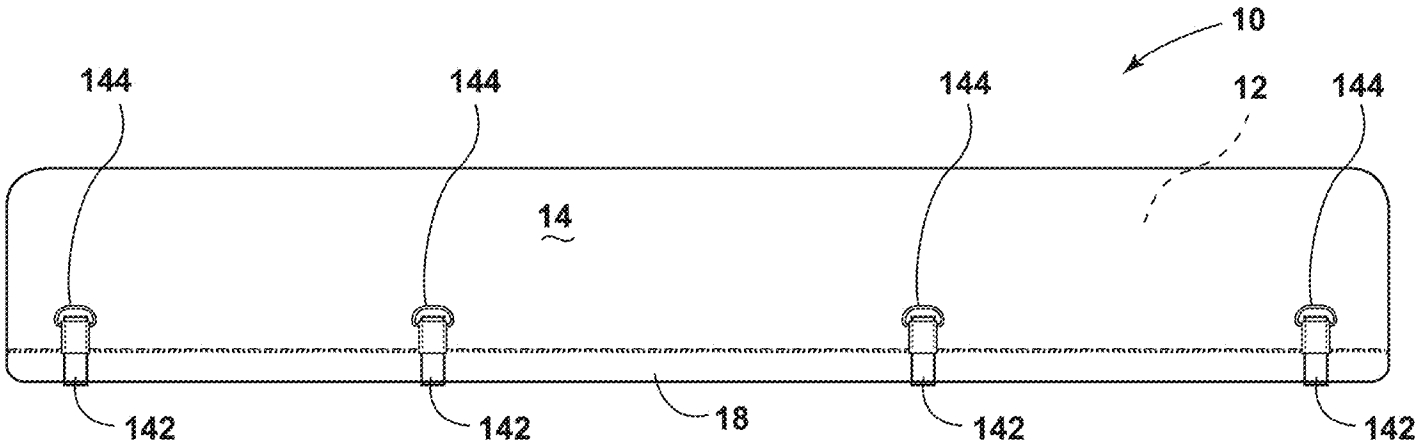
FIG. 8 is a side elevational view of a mattress cover, a support casing, and a coupling feature of a mattress support of the present disclosure.
Figure 9:
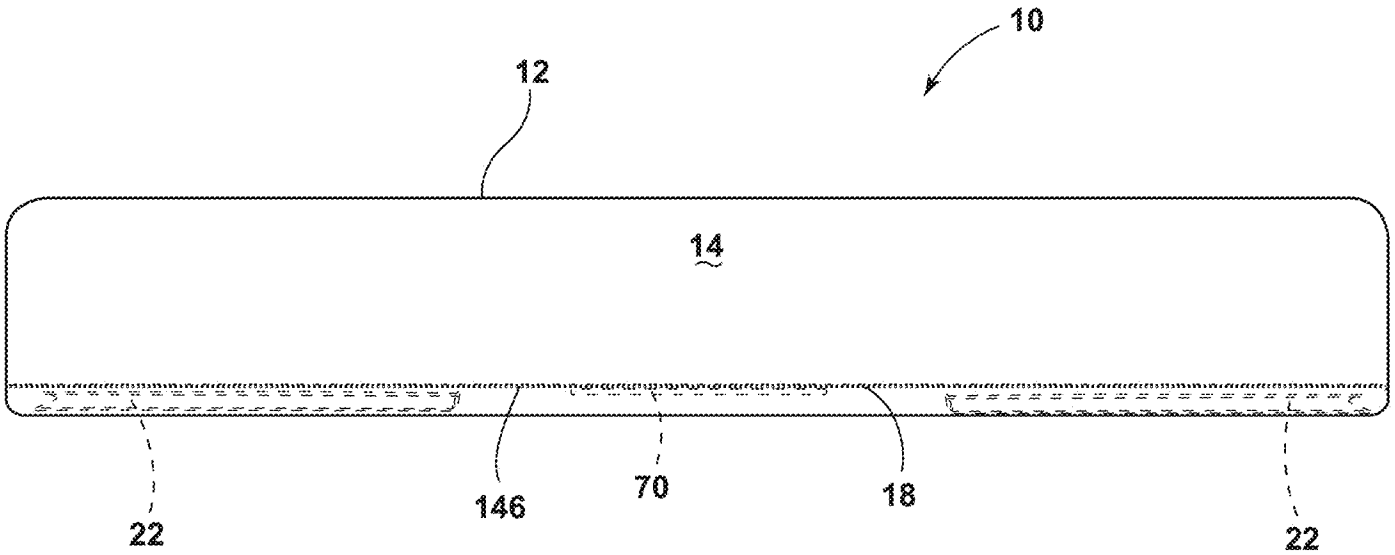
FIG. 9 is a side elevational view of a mattress and a mattress support of the present disclosure.

With reference now to FIGS. 7-9, the mattress cover 14 is operably coupled to the support casing 18 by the coupling feature 16. In one example, the coupling feature 16 is a clasp locker 136, commonly referred to as a zipper. As described further below, the clasp locker 136 includes a first clasp member 138 (FIG. 10) and a second clasp member 140 (FIG. 11) coupled to the mattress cover 14 and the support casing 18, respectively. In an alternative depiction, as shown in FIG. 8, the coupling feature 16 includes straps 142. The mattress cover 14 is coupled to the support casing 18 by securing the straps 142 through aperture rings 144. Alternatively, where the mattress support 28 is incorporated within the medical mattress, a seam 146 couples the mattress cover 14 and the support casing 18, as shown in FIG. 9.

An integrated configuration of the mattress support 28 with the mattress 12, such as that illustrated in FIG. 9, eliminates or reduces the need for assembly (i.e. connecting the mattress support 28 with the mattress 12). Accordingly, where physical manipulation of the mattress 12 is not desirable or not possible, the user can purchase the mattress 12 with the mattress support 28 already included. In some instances, the support casing 18, the support member 22, and the sensor pad 70 may have a weight range between approximately seven kilograms and approximately eighteen kilograms. Purchase of the mattress 12 with the mattress support 28 eliminates the user or a third party from having to install the mattress support 28 onto the mattress 12. Rather, the mattress 12 and mattress support 28 can simply be positioned on the bed without further assembly. It is also contemplated that the mattress support 28 may be partially integrated with the mattress 12, such that the mattress cover 14 and the coupling features 16 are integral with the mattress 12. In such configuration, the user merely places the mattress 12 on the support casing 18 and couples the support casing 18 to the mattress cover 14, which is integral with the mattress 12.

Alternatively, as previously noted with reference to FIGS. 7 and 8, it is also possible to purchase the mattress support 28 separately from the mattress 12. In this instance, the support casing 18, along with the support member 22 and the sensor pad 70, may be positioned beneath the mattress 12 on the frame 46 (FIG. 2) of the bed 40 (FIG. 2). At the same time, the mattress cover 14 is fitted over the mattress 12. It is generally contemplated that the mattress cover 14 may be configured to fit over various mattresses 12 of different shapes and sizes. A user may utilize coupling features 16 such as the straps 142 and aperture rings 144 to secure the mattress support 28 to the mattress 12. The user can tighten or loosen the straps 142 to operably couple the mattress cover 14 to the support casing 18 while also fitting the mattress support 28 to the existing mattress 12. It will be understood that although straps 142 are illustrated, buckles, snaps, clasps, hook and loop fasteners, and other detachable fastening arrangements may also be utilized. It will also be understood that the mattress support 28 and the coupling features 22 may include hydrophobic properties, such that liquids, including medicinal liquids and body fluids, may be prevented from penetrating the mattress 12.

Figure 10:
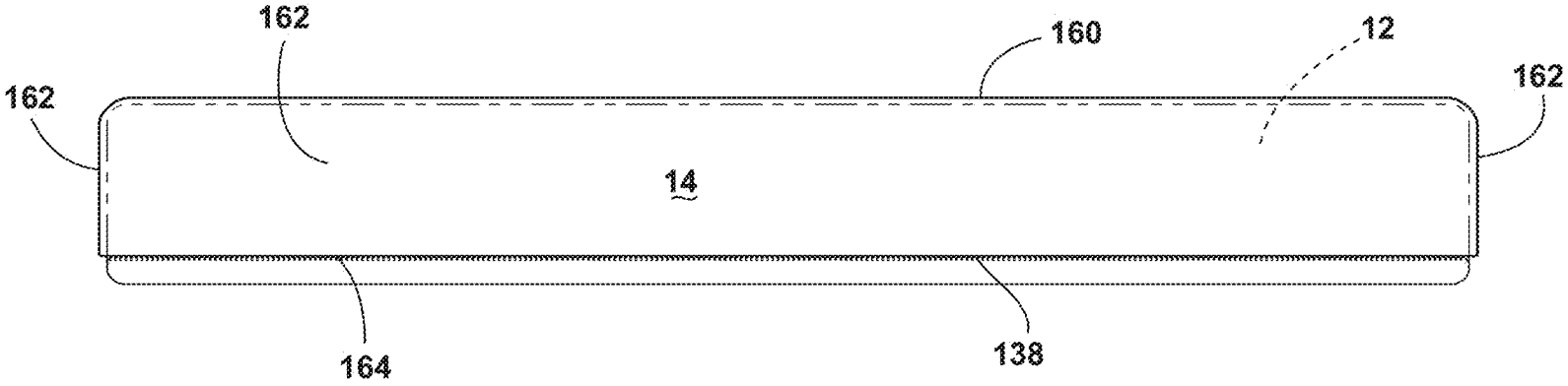
FIG. 10 is a side elevational view of a mattress cover of a mattress support of the present disclosure.
Figure 11:
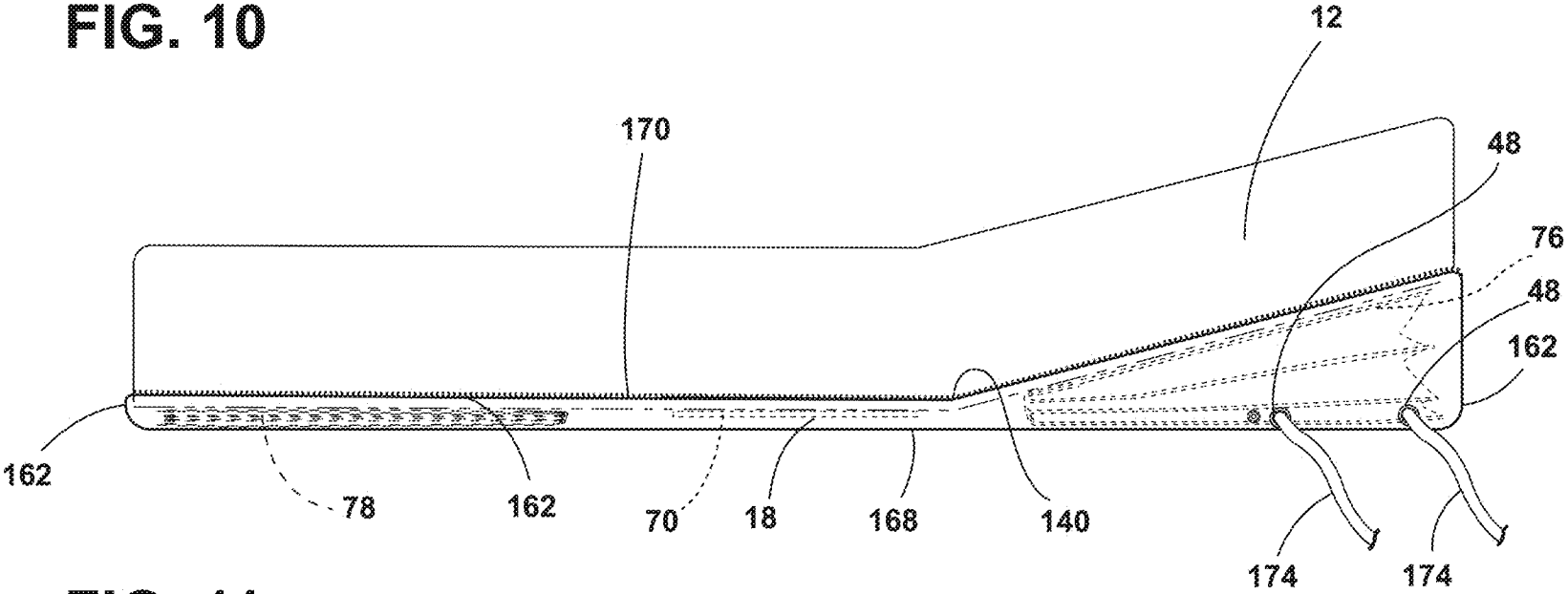
FIG. 11 is a side elevational view of a mattress supported on a support member in a deployed condition, a sensor, and a support casing of a mattress support of the present disclosure.

With reference now to FIGS. 10 and 11, the mattress cover 14 typically covers a majority of the mattress 12 and includes a top surface 160 and side portions 162 defining a peripheral edge 164. By way of example, not limitation, the first clasp member 138 of the clasp locker 136 (FIG. 7) defines the peripheral edge 164, as depicted in FIG. 10. A perimeter 170 of the support casing 18 is defined by the second clasp member 140 of the clasp locker 136 (FIG. 7), such that the peripheral edge 164 of the mattress cover 14 is coupled to the perimeter 170 of the support casing 18 by the first and second clasp members 138, 140. Stated differently, the first and second clasp members 138, 140 couple the mattress cover 14 to the support casing 18.

The support casing 18 includes a bottom surface 168 and side portions 162, which define the apertures 48 and the connecting features 50. The apertures 48 may be configured to receive tubes 174, which further connect to the ports 102 of the support members 22 and provide pressure to deploy and compress the support members 22. For example, the tubes 174 may couple to the ports 102 (FIG. 5) to supply the support member 22 with the fluid for deploying the expandable body 100. The fluid may be ambient air, a gaseous substance, liquids, or another fluid typically used for deploying known in the art. Additionally or alternatively, the apertures 48 may allow cords and/or wires for the sensor pad 70 to pass through the side portions 162 of the support casing 18.

With further reference to FIGS. 10 and 11, it is generally contemplated that the support casing 18 is more pliable than the mattress cover 14 due to the placement and function of the support casing 18. As illustrated, the mattress cover 14 extends along a majority of the mattress 12, such that the mattress cover 14 primarily covers the mattress 12. Comparatively, the support casing 18, positioned beneath the mattress 12, extends along the mattress 12 to the extent that the support casing 18 couples to the mattress cover 14. However, it is also contemplated that the support casing 18 may alternatively extend along a greater area of the mattress 12 than the mattress cover 14. The attachment features 20 of the support casing 18 help to retain the support member 22 and the sensor pad 70 relative to the mattress 12. As illustrated, the support casing 18 has a thickness sufficient to retain the support member 22 and the sensor pad 70, while the pliability of the support casing 18 accommodates the expandability of the support member 22.

For example, the support casing 18 is comprised of a generally elastomeric material, such that as the support member 22 passes through deployed and non-deployed conditions 24, 26 the support casing 18 correspondingly stretches and relaxes, respectively. Additionally or alternatively, the support casing 18 may be a generally bellow or accordion design similar to the depicted support member 22. Accordingly, the support casing 18 is more flexible relative to the mattress cover 14 in that the support casing 18 expands, contracts, and otherwise stretches. This allows the mattress 12 to laterally rotate, vertically raise, and/or generally be repositioned with minimal restraint from the support casing 18. The minimal restraint that may be provided by the support casing 18 and the mattress cover 14 may also provide at least partial stabilization of the mattress 12 while the support member 22 is in the deployed condition 24. It is generally contemplated, however, that the mattress support 28 may be used in conjunction with other known retention mechanisms for the mattress 12 during various articulations.

Referring again to FIGS. 1-11, the mattress support 28 as described herein allows for user-friendly incorporation of a support member 22 to a mattress 12. It can be a challenge to assemble support members 22, sensor pads 70, and other medical equipment, such as the safety rail 52, to an existing mattress 12. Thus, purchasing the mattress 12 with the mattress support 28 already incorporated allows the user to simply place the assembled mattress 12 on the frame 46 of the bed 40. Alternatively, the mattress support 28 can be incorporated with an already owned mattress 12 eliminating the need to buy a new mattress 12. The mattress support 28 provides a reliable interface between the support casing 18 and the mattress 12 that minimizes or eliminates slippage or relative movement between the support casing 18 and the mattress 12 over time.

In sum, according to an aspect of the present disclosure, a mattress assembly includes a mattress including a mattress cover and a coupling feature coupled to the mattress cover. A support casing is disposed beneath the mattress and is operably coupled to the mattress cover via the coupling feature. The support casing defines at least one attachment feature. At least one support member is disposed on and, is selectively coupled with, the at least one attachment feature of the support casing. The at least one support member is operable between a deployed condition and a non-deployed condition.

According to another aspect of the present disclosure, a sensor pad is operably coupled with at least one attachment feature of a support casing. A controller is communicatively coupled to the support pad.

According to still another aspect of the present disclosure, a mattress has a first head portion and a second head portion. The first head portion is selectively and independently movable relative to the second head portion.

According to yet another aspect of the present disclosure, at least one support member includes a first support member positioned at a first head portion and a second support member positioned at a second head portion. The first support member is selectively in a deployed condition and a second support member is selectively in a non-deployed condition.

According to yet another aspect of the present disclosure, at least one support member includes a first air bladder and a second air bladder adjacent to the first air bladder. The first air bladder and the second air bladder are positioned at a head portion and a foot portion of one side of a mattress, respectively.

According to still another aspect of the present disclosure, at least one attachment feature includes a first clip and a second clip. A first air bladder and a second air bladder are operably coupled to the first clip and the second clip, respectively.

According to still another aspect of the present disclosure, at least one attachment feature includes a third clip. A sensor pad is operably coupled to the third clip.

According to another aspect of the present disclosure, a mattress support includes a mattress cover and a support casing defining an attachment feature. A support member is selectively coupled with the attachment feature of the support casing. The support member is operable between a deployed condition and a non-deployed condition. A coupling feature couples the mattress cover to the support casing.

According to another aspect of the present disclosure, a support member extends along a width of a support casing.

According to still another aspect of the present disclosure, a support member further includes an expandable body.

According to yet another aspect of the present disclosure, a support member further includes a plurality of folds and a plurality of rims. The plurality of folds and the plurality of rims at least partially define the expandable body.

According to another aspect of the present disclosure, a support member has a static end and a dynamic end. The dynamic end is movable between a deployed condition and a non-deployed condition.

According to still another aspect of the present disclosure, a support member selectively fills with fluid in a deployed condition. The fluid is selectively released from the support member in a non-deployed condition.

According to yet another aspect of the present disclosure, a support member comprises a bellows.

According to another aspect of the present disclosure, a mattress support assembly includes a mattress cover that has a coupling feature. A support casing defines an attachment feature and is selectively coupled to the mattress cover via the coupling feature. A support member is operably coupled to the attachment feature of the support casing. The support member has a load surface, a base surface, and an expandable body defined between the load surface and the base surface.

According to another aspect of the present disclosure, a base surface of a support member is coupled to an attachment feature of a support casing.

According to yet another aspect of the present disclosure, a support member further includes a static end and a dynamic end. The dynamic end is operable between a deployed condition and a non-deployed condition.

According to still another aspect of the present disclosure, a support casing defines ports configured to receive tubes.

According to another aspect of the present disclosure, an expandable body includes a bladder.

According to still another aspect of the present disclosure, a support casing is comprised of an elastomeric material.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A mattress assembly, comprising: a mattress including a mattress cover and a coupling feature coupled to the mattress cover; a support casing disposed beneath the mattress and operably coupled to the mattress cover via the coupling feature, wherein the support casing defines at least one attachment feature; a sensor pad operably coupled directly with one of the support casing and the mattress cover; a controller communicatively coupled to the sensor pad; and at least one support member disposed on the support casing and operably coupled to the at least one attachment feature, wherein the at least one support member is operable between a deployed condition and a non-deployed condition.

2. The mattress assembly of claim 1, wherein the mattress has a first head portion and a second head portion, and wherein the first head portion is selectively and independently movable relative to the second head portion.

3. The mattress assembly of claim 2, wherein the at least one support member includes a first support member positioned at the first head portion and a second support member positioned at the second head portion, and wherein the first support member is selectively in the deployed condition and the second support member is selectively in the non-deployed condition.

4. The mattress assembly of claim 1, wherein the at least one support member includes a first air bladder and a second air bladder adjacent to the first air bladder, and further wherein the first air bladder and the second air bladder are positioned at a head portion and a foot portion of one side of the mattress, respectively.

5. The mattress assembly of claim 4, wherein the at least one attachment feature includes a first clip and a second clip, and further wherein the first air bladder and the second air bladder are operably coupled to the first clip and the second clip, respectively.

6. The mattress assembly of claim 5, wherein the at least one attachment feature includes a third clip, and further wherein the sensor pad is operably coupled to the third clip.

7. The mattress assembly of claim 1, wherein the at least one support member is operably coupled to the at least one attachment feature of the support casing.

8. The mattress assembly of claim 1, wherein the at least one support member has a load surface, a base surface, and an expandable body defined between the load surface and the base surface.

9. The mattress assembly of claim 8, wherein the base surface of the at least one support member is coupled to the at least one attachment feature of the support casing.

10. The mattress assembly of claim 8, wherein the at least one support member further includes a plurality of folds and a plurality of rims, and wherein the plurality of folds and the plurality of rims at least partially define the expandable body.

11. The mattress assembly of claim 1, wherein the at least one support member further includes a static end and a dynamic end, and wherein the dynamic end is operable between the deployed condition and the non-deployed condition.

12. The mattress assembly of claim 1, wherein the support casing defines ports configured to receive tubes.

13. The mattress assembly of claim 1, wherein the support casing is comprised of an elastomeric material.

14. The mattress assembly of claim 1, wherein the at least one support member extends along a width of the support casing.

15. The mattress assembly of claim 1, wherein the at least one support member selectively fills with fluid in the deployed condition, and wherein the fluid is selectively released from the at least one support member in the non-deployed condition.

16. The mattress assembly of claim 1, wherein the at least one support member comprises a bellows.

* * * * *